United States Patent [19]

Clayton

[11] Patent Number: 4,989,322

[45] Date of Patent: Feb. 5, 1991

[54] HAIR SHEARING DEVICE

[76] Inventor: Duke Clayton, 5520 Johnston St., Lafayette, La. 70503

[21] Appl. No.: 363,140

[22] Filed: Jun. 8, 1989

[51] Int. Cl.[5] ..... B26B 15/00

[52] U.S. Cl. ..... 30/228; 30/247; 30/249

[58] Field of Search ..... 30/215, 216, 217, 219, 30/228, 247, 249

[56] References Cited

U.S. PATENT DOCUMENTS

| | | | |
|---|---|---|---|
| 2,621,404 | 12/1952 | Koons | 30/247 X |
| 4,328,616 | 5/1982 | Andis | 30/225 |
| 4,329,781 | 5/1982 | Schemmann et al. | 30/34.2 |
| 4,449,300 | 5/1984 | Maledon | 30/230 |
| 4,532,707 | 8/1985 | Allen | 30/200 |
| 4,578,862 | 4/1986 | Braun | 30/43.92 |
| 4,602,431 | 7/1986 | Keel | 30/229 |
| 4,628,601 | 12/1986 | Van Slooten | 30/133 |
| 4,669,189 | 6/1987 | Ullmann | 30/201 |
| 4,679,322 | 7/1987 | Hunts | 30/133 |

*Primary Examiner*—Douglas D. Watts

*Attorney, Agent, or Firm*—Fleit, Jacobson, Cohn, Price, Holman & Stern

[57] ABSTRACT

A hair shearing device is driven by a motor to duplicate the cut obtained by manually operated scissors. One blade of the hair shearing device is held stationary while the other blade is powered to cross over the stationary blade at a predetermined speed. The speed of the movable blade is controlled and is variable.

8 Claims, 1 Drawing Sheet

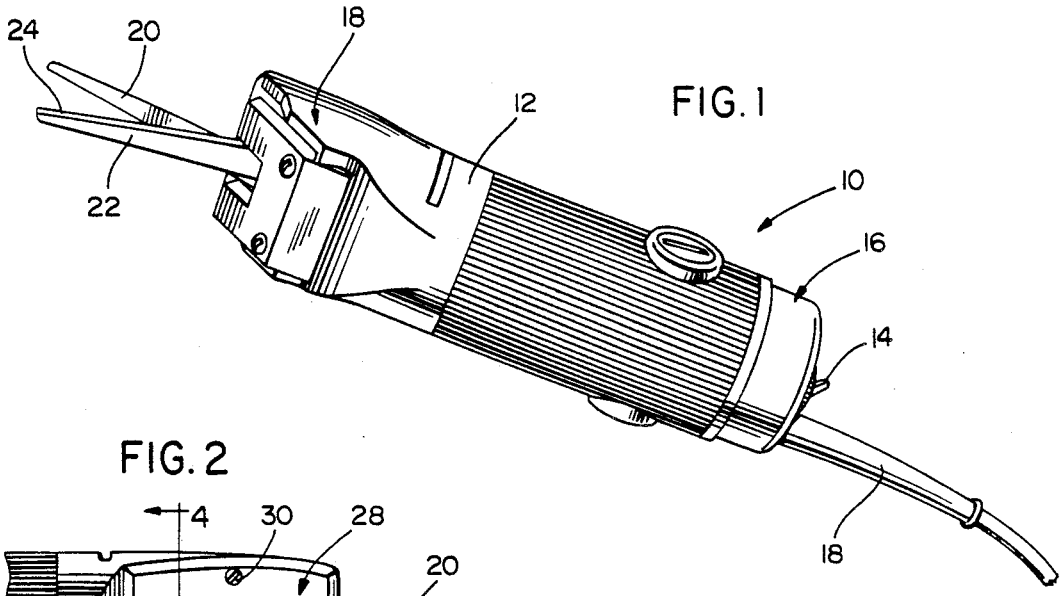
FIG. 1
FIG. 2
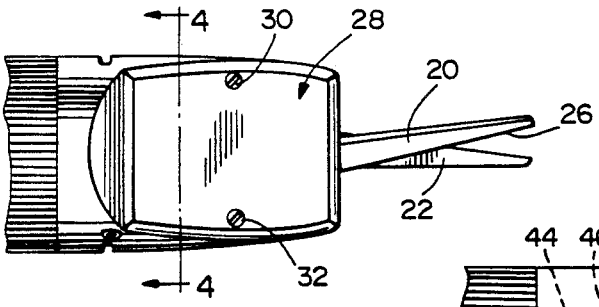
FIG. 3
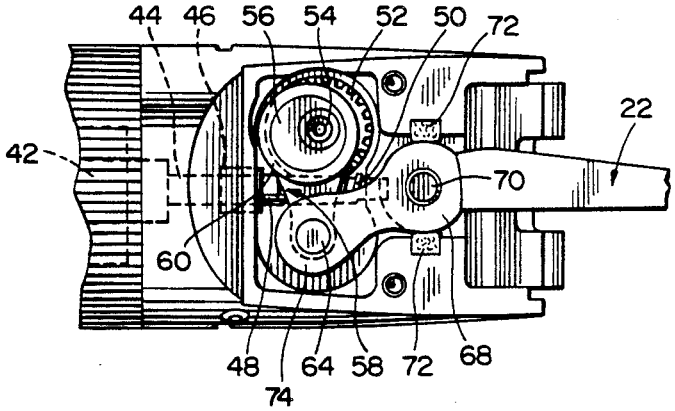
FIG. 6
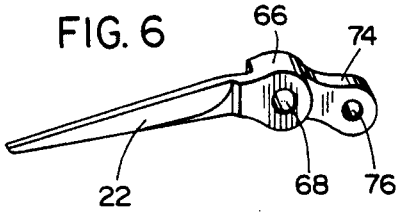
FIG. 4
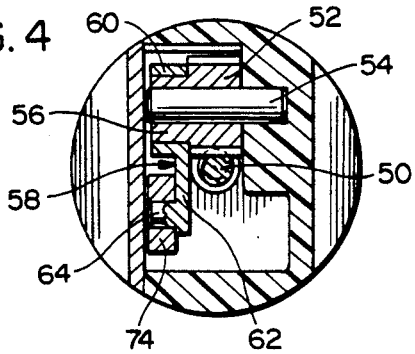
FIG. 5
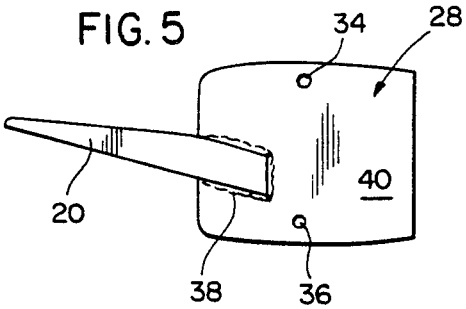

HAIR SHEARING DEVICE

FIELD OF THE INVENTION

This invention relates to an improved hair shearing device designed to duplicate a typical scissor cut which has previously been manually performed with a scissors for hair styling.

BACKGROUND OF THE INVENTION

There are many known hair clippers which incorporate oscillating blades. Typically, two blades having a plurality of channels are caused to move back and forth with respect to each other and which trap hair between the channels of both sidewardly reciprocating blades to thereby shear hair. These oscillating blades fail to reproduce the amount of control and styling which are produced by a scissor cut.

SUMMARY OF THE PRESENT INVENTION

By the present invention, a hair shearing device is driven by a motor to duplicate the cut obtained by manually operated scissors. One blade of the hair shearing device is held stationary while the other blade is powered to cross over the stationary blade at a predetermined speed. The speed of the movable blade is controlled and is variable.

The device of the invention is intended to be held in the hand of a hair stylist. The weight and center of gravity are tuned to allow the hair stylist to position the hair shears in many different directions which will result in a desired hair style.

The hair cutting shears of the invention are powered by an electric- or air-operated drive system. The cutting shears provide for the shearing of hair at a continuous speed using a pair of sharpened blades. The speed of the movable blade crossing across the stationary blade in a normal scissors movement is within the operators control. The design of the blades allows the hair stylist the capability of performing precision cuts that are required in the hair styling business.

It is an object of the present invention to provide a hair cutting device which is driven by an external source to duplicate the cut obtained by scissors manually shearing hair.

It is another object of the present invention to provide a device for cutting hair having a fixed blade and a movable blade which duplicate the movement of scissors to cut hair at a controlled speed.

It is yet another object of the present invention to provide a hand-held hair cutting device having two blades movable in a scissors-like manner by the use of a movable blade which moves across a fixed blade at a controlled speed for the cutting of hair.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a perspective view of a hair shearing device.

FIG. 2 is a top plan view of a portion of the device.

FIG. 3 is a top plan view with a cover plate removed.

FIG. 4 is a sectional view taken along line 4—4 of FIG. 2.

FIG. 5 is a bottom view of the cover plate having a fixed blade.

FIG. 6 is a perspective view of a movable blade.

DETAILED DESCRIPTION OF THE PREFERRED EMBODIMENTS

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIG. 1, in particular, a hair shearing device embodying the teachings of the subject invention is generally designated as 10. The device 10 includes a cylindrical plastic housing 12.

At one end 16 of the housing 12 is an on-off switch 14. At end 16 is an electrical cord 18 which supplies electrical current from a power source. At the opposite end 18 of the housing are fixed blade 20 and movable blade 22. In FIG. 1, cutting edge 24 of movable blade 22 is shown. In FIG. 2, the cutting edge 26 for fixed blade 20 is shown.

In FIG. 2, removable cover plate 28 is shown which has two screws 30 and 32 extended through holes 34 and 36 respectively (as shown in FIG. 5) for securing the top plate 28 onto the housing 12. Fixed blade 20 is secured by weld 38 to the underside 40 of cover plate 28.

Upon removal of cover plate 28, as shown in FIG. 3, the drive mechanism for the movable blade 22 is shown. Motor 42 is shown in dotted lines in FIG. 3, located within housing 12.

The motor 42 includes a drive shaft 44 which is connected by coupling 46 to a threaded worm shaft 48. Threaded worm shaft 48 includes threads 50 which engage worm wheel 52 which is rotatably mounted on pin 54. While the worm gear 52 is axially mounted on the pin 54, an upper eccentric portion 56 of the worm gear is mounted eccentrically with respect to pin 54. Eccentric portion and worm gear are of integral construction with a center of eccentric portion being offset from the center of worm gear 52 and pin 54.

A crank arm 58 includes an annular ring portion 60 at one end which surrounds the periphery of the eccentric portion 56 of the worm gear 52. A laterally extending portion 62 of the crank arm interconnects an upstanding pin 64 which projects from the crank arm 58 at an opposite end of the crank arm from the annular ring portion 60.

Movable blade 22 includes a central pivot portion 66 having hole 68. The pivot portion 66 is mounted on fixed pin 70 which extends from the housing. On opposite sides of the movable portion 68 are felt bushings 72 which protect sheared hair from passing into the interior of the housing 12. Rocking portion 74 of the movable blade 22 includes an opening 76 which is mounted onto the lever arm 58 so that the pin 64 which extends from crank arm 58 passes through opening 76.

By rotation of the motor shaft 44, through coupling 46 to the worm shaft 48, the worm gear 52 is driven. The eccentric portion 56 of the worm gear 52 moves ring portion 60 of crank arm 58. The pin 64 of the crank arm 58 is thereby reciprocated to move the rocking portion 74 of the movable blade 22 back and forth along a straight line. The movable blade 22 thereby pivots about pin 70 to cause the cutting edge 24 to move back and forth. The blade 22 thereby moves back and forth across the fixed blade 20 to duplicate a scissor cutting action.

The electric cord 18 which provides electric current to the motor 42 may be plugged into a POWERSTAT variable autotransformer, type number 116B, available from The Superior Electric Company, Bristol, Conn. By movement of a dial of the autotransformer, the amount of current supplied to motor 42 is thereby varied to ultimately control the speed of the movable blade 22 crossing over the fixed blade 20.

Having described the invention, many modifications thereto will become apparent to those skilled in the art to which it pertains without deviation from the spirit of the invention as defined by the scope of the appended claims.

I claim:

1. A hair shearing device comprising:

a housing, a fixed scissor blade mounted on said housing, a movable scissor blade pivotably mounted on said housing, drive means mounted in said housing for driving said movable blade to cross over said fixed blade to duplicate a manual scissor cutting action, said drive means including an electric motor, said drive means including a linkage between said motor and said movable blade, said linkage including a crank arm interconnecting one end of said movable blade and said motor for reciprocating movement of said movable blade by a pivoting movement of said movable blade about a pivot pin located between the ends of said movable blade, and said crank arm including an annular ring-portion at one end and a pin at an opposite end, said pin engaging said one end of said movable blade.

2. A hair shearing device as claimed in claim 1, wherein said fixed blade is mounted on a cover plate for said linkage.

3. A hair shearing device as claimed in claim 2, wherein fixed blade is mounted on the interior of said housing.

4. A hair shearing device as claimed in claim 3, wherein said motor includes a shaft connected to a worm shaft for driving a worm gear having an eccentric portion about which is located said annular ring portion.

5. A hair shearing device comprising:

a cylindrical housing, a motor located within said housing, a fixed scissor blade mounted on said housing, a movable scissor blade pivotably mounted on said housing, linkage means for interconnecting said motor and said movable blade for moving said movable blade across said fixed blade upon energization of said motor to produce a shearing action, said movable blade being pivotably mounted on a pin mounted on said housing at a point located between the ends of said movable blade, and said linkage means including a worm shaft connected to a motor shaft of said motor, and a worm gear being driven by said worm shaft to move a linkage arm connected to one end of said movable blade to pivot said movable blade about said pin.

6. A hair shearing device as claimed in claim 5, wherein said worm gear includes an eccentric portion and an annular ring portion of said linkage arm surrounds said eccentric portion for rocking of said one end of said movable blade which is mounted on a pin of said linkage arm spaced from said annular ring portion.

7. A hair shearing device as claimed in claim 6, wherein said fixed scissor blade is mounted on a cover plate of said housing.

8. A hair shearing device as claimed in claim 7, wherein a cutting edge of said movable blade is at an end opposite to said one end.

* * * * *